US010045129B2

(12) United States Patent
Maas et al.

(10) Patent No.: US 10,045,129 B2
(45) Date of Patent: Aug. 7, 2018

(54) MEASUREMENT APPARATUS FOR A BONE CONDUCTION HEARING DEVICE

(71) Applicant: Oticon Medical A/S, Smørum (DK)

(72) Inventors: Patrick Maas, Smørum (DK); Dylan Kyle Scott, St. Albert (CA)

(73) Assignee: OTICON MEDICAL A/S, Smorum (DK)

( * ) Notice: Subject to any disclaimer, the term of this patent is extended or adjusted under 35 U.S.C. 154(b) by 0 days.

(21) Appl. No.: 15/298,904

(22) Filed: Oct. 20, 2016

(65) Prior Publication Data

US 2017/0118563 A1 Apr. 27, 2017

(30) Foreign Application Priority Data

Oct. 21, 2015 (EP) ..... 15190794

(51) Int. Cl.
*H04R 25/00* (2006.01)

(52) U.S. Cl.
CPC ..... *H04R 25/30* (2013.01); *H04R 25/505* (2013.01); *H04R 25/606* (2013.01); *H04R 2460/13* (2013.01)

(58) Field of Classification Search
None
See application file for complete search history.

(56) References Cited

U.S. PATENT DOCUMENTS 3,134,861 A * 5/1964 Dempsey ..... H04R 1/105 381/151
2007/0154026 A1* 7/2007 Chiu ..... H03F 1/305 381/71.1
2008/0064993 A1* 3/2008 Abolfathi ..... A61M 21/00 601/47
2011/0301404 A1* 12/2011 Bern ..... H04R 25/606 600/25

(Continued)

FOREIGN PATENT DOCUMENTS

EP 2 393 309 A1 12/2011
EP 2925022 A1 9/2015
WO WO 98/35530 A1 8/1998

*Primary Examiner* — Curtis Kuntz
*Assistant Examiner* — Kenny Truong
(74) *Attorney, Agent, or Firm* — Birch, Stewart, Kolasch & Birch, LLP

(57) ABSTRACT

According to an embodiment, an apparatus for sensing vibrations produced by a bone conduction hearing aid is disclosed. The apparatus includes a proximal end, a distal end and a side surface. The proximal end comprising a proximal periphery comprising a material adapted to, during a measurement, contact a skin of a user of the bone conduction device and to enclose a skin area within the proximal periphery. The distal end comprising a measurement microphone adapted to, during the measurement, receive an acoustic signal in dependence of vibrations produced at the skin area, the vibrations being representative of skull vibrations produced within the user by the bone conduction hearing aid in response to a sound signal. The side surface, in combination with the proximal periphery and the distal (Continued)

end, adapted to define an acoustic signal transmission cavity that allows transmission of the acoustic signal from the skin area to the measurement microphone during the measurement.

18 Claims, 5 Drawing Sheets

(56) References Cited

U.S. PATENT DOCUMENTS

| | | | | |
|---|---|---|---|---|
| 2012/0014532 | A1* | 1/2012 | Kimura | H04R 1/1083 381/71.6 |
| 2012/0302822 | A1* | 11/2012 | Van Himbeeck | H04R 25/606 600/25 |
| 2013/0245362 | A1 | 9/2013 | Elofsson | |
| 2014/0107526 | A1* | 4/2014 | Thibaut | A61B 5/4851 600/559 |
| 2014/0283614 | A1* | 9/2014 | Inagaki | H04M 1/24 73/649 |

* cited by examiner

MEASUREMENT APPARATUS FOR A BONE CONDUCTION HEARING DEVICE

FIELD

The disclosure relates to a measurement apparatus and a method thereof. In particular, the disclosure relates to an apparatus that is configured to detect vibrations produced by a bone-conduction hearing device as well as for facilitating calibration and/or operation of the bone-conduction hearing device.

BACKGROUND

Air conduction (AC) hearing aids are generally used in the rehabilitation of patients with a hearing impairment. However, for certain ear canal and middle ear disorders such as congenital malformations, chronic ear infections, draining ears, and eczema in the ear canal, etc., AC hearing aids cannot be used or are insufficient. In such cases, a conventional bone conduction (BC) hearing aid may be provided as an alternative. Bone conduction is a mechanism for delivering sound to the cochlea by sending vibrations through the skull rather than the eardrum and middle ear as in ordinary air conduction hearing.

Sound is transduced into neural impulses at the inner hair cells of the cochlea. Thus in order to achieve hearing, an actuator must have a means for moving these hair cells. In ordinary air-conducted hearing, pressure oscillations in air drive the motion of the tympanic membrane which is connected to the oval window of the cochlea through the middle ear ossicles. The stapes footplate pushes the oval window in and out, driving fluid through the cochlea. The resulting fluid pressure shears the basilar membrane to which the hair cells are attached, and their motion opens ion channels that trigger neural impulses. In BC hearing aids; when the skull vibrates, a variety of inertial and elastic effects transmit some fraction of those vibrations to the cochlear fluids and thence to the hair cells.

In a known type of bone conduction hearing devices, a vibrator is pressed against the skin of the person's head by means of a spring or an elastic headband, and which transmits the vibrations to the skull bone through the skin and the subcutaneous tissue.

Another well-known type of bone-conduction hearing devices comprises a vibrator detachably coupled via an abutment to a fixture implanted in the skull bone. The vibrator transmits the vibrations to the skull bone through the fixture. Yet another type of bone conduction hearing devices include a vibrator that is surgically implanted and affixed to the skull using screws. The vibrator transmits the vibrations to the skull bone through the screw. In all these implementations, the skull vibrations result in motion of the fluid of the cochlea, thereby stimulating the cochlear hair cells and causing the perception of sound in the recipient of the bone conduction hearing device.

For bone-conduction hearing devices, a precise determination of the vibrations applied to the skull bone is needed for determining a person's bone-conduction hearing thresholds as well as for calibrating the bone conduction hearing device. Therefore, attempts have been made to develop devices and methods for determining the applied vibrational force. For example, a proposal is made where an accelerometer is attached on a counter weight of a bone conduction vibrator. The accelerometer provides an acceleration signal, representative of an acceleration of the counter mass, from which the vibrational force may be determined. The disadvantages with such proposal include that only one specific device may be measured and incorporating the accelerometer requires space in the transducer because access to the counterweight is required.

Therefore, it is of interest to have a measurement device that is capable of determining applied vibrational force produced at the skull by a bone-conduction device. Such detection may form basis for calibrating and/or operating the bone-conduction device.

SUMMARY

The disclosure is described in relation to a percutaneous bone anchored hearing aid. However, it is evident that the disclosure is also applicable on other bone conduction hearing aids adapted to produce hearing perception using transmission of vibrations through skull bone to cochlea such as in transcutaneous bone conduction hearing aids, which may be both direct drive i.e. vibrations delivered directly to the skull bone such as bone conduction device having an implanted vibration unit or passive drive i.e. vibrations delivered indirectly such as through skin to the skull bone. In an embodiment, a typical percutaneous bone anchored hearing aid includes an implantable titanium percutaneous screw-abutment that is surgically implanted into the skull, and a separate external device adapted to couple with the implanted screw-abutment. The external device includes a sound input component, speech processor, a vibration unit and a power unit. The sound input component, such as microphone, is adapted to receive an incoming sound such as from auditory environment or a test signal (sound signal) and to generate a corresponding electrical signal. The electronics module (speech processor) is adapted to process the electrical signal including amplifying the electrical signals and accordingly to drive the vibration unit (transducer) that is adapted to convert the electrical signal into a mechanical force for delivery to the recipient's skull. The transducer is configured to generate vibrations typically substantially along one displacement axis that is usually substantially perpendicular to skull surface. The power unit provides an electrical supply current and voltage for the electronics module and the vibration unit. A conventional vibration unit includes an armature, a yoke and an air gap. A spring suspension connects the yoke to the armature, thereby maintaining the essential air gap between them. The magnetic flux is composed of the static flux generated by a permanent magnet and a dynamic flux is generated by the current in coil(s) surrounding a bobbin. Transmission of the alternating current signal of an amplifier of the electronics module to the terminals of the coil causes the armature to vibrate because of the modulated magnetic field. The vibrations produced in response to the total force is then transmitted to the skull via the implanted titanium percutaneous screw-abutment. The received vibrations at the skull is delivered to the cochlea by sending vibrations through the skull. The total force that the vibration unit generates between the yoke and the armature is approximately proportional to the total magnetic flux square, i.e. $F_{tot}\ \alpha(\Phi_s+\Phi_\sim)^2=\Phi_s^2+2\ \Phi_s\Phi_\sim+\Phi_\sim^2$ where $\Phi_s^2$ represents stating force from the permanent magnet, $2\ \Phi_s\Phi_\sim$ represents the desired signal force and $\Phi_\sim^2$ represents an undesired distortion force. It is evident that the signal force generated thus relates to the dynamic flux and in turn, to the applied alternating current to the coil where the applied current is dependent upon frequency specific signal level of the incoming sound and a desired force based on frequency specific hearing threshold of the user. This is generally also applicable for other vibration unit technologies.

According to an embodiment, an apparatus for sensing vibrations produced by a bone conduction hearing aid is disclosed. The apparatus includes a proximal end, a distal end and a side surface. The proximal end includes a proximal periphery comprising a material adapted to, during a measurement, contact a skin of a user of the bone conduction device and to enclose a skin area within the proximal periphery. The distal end comprising a measurement microphone adapted to, during the measurement, receive an acoustic signal in dependence of vibrations produced at the skin area, the vibrations being representative of skull vibrations produced within the user by the bone conduction hearing aid in response to a sound signal. The side surface, in combination with the proximal periphery and the distal end, adapted to define an acoustic signal transmission cavity that allows transmission of the acoustic signal from the skin area to the measurement microphone during the measurement.

As described earlier, when the sound signal of a predefined characteristics such as a frequency and level is applied to the bone conduction hearing aid in use by the user, the sound signal produces, at the skull bone, mechanical vibrations that are transmitted via the user skull to the inner ear. These mechanical vibrations define the skull vibrations produced within the user. Because of these mechanical vibrations, the skin over the skull vibrating in response to the sound signal also vibrates. Thus, vibrations of the skin relate to these skull vibrations, i.e. vibrations within the user. In other words, the amplitude of the vibrations of the skin relate to effective transfer function of the bone conduction hearing aid, i.e. relation between input (current supplied to the coil of the vibration unit) and output (force produced at the skull) of the bone conduction hearing aid. The acoustic signal is defined as mechanical waves generated, in a medium such as air present in the acoustic cavity, by the vibrations at the skin enclosed within the proximal periphery when the apparatus is positioned over the skin area.

The measurement relates to determining transfer function of the bone conduction hearing aid when the bone conduction hearing aid is mounted on the head of the hearing aid user.

The material may include a vibration damping material. In various embodiments, the material is selected from a group consisting of silicone material, rubber material, synthetic rubber material, neoprene, polyurethane, and Polytetrafluoroethylene (PTFE). However, the skilled person would realize that other material satisfying the criterion of vibration damping may also be used. Using such material ensures that the shaking of the apparatus during the measurement is avoided or at least substantially limited, thus not negatively affecting the measurement of the vibrations. Although such material does not substantially restrict vibration of the skin at contact skin, i.e. at the proximal periphery but the material dampens the skin vibration, restricting transfer of the skin vibrations to the side surface and thus restricting the skin vibration vibrating the apparatus. The material is typically either wrapped around the proximal periphery or is attached to the proximal periphery or the proximal periphery is made of the material such that the material runs along length of the proximal periphery. These embodiments define the proximal periphery comprising the material. During measurement, the material contacts the specific skin area and forms a sealing with the skin surface in contact, thus forming a sealed acoustic cavity, in combination with the side surface and the distal end, along which the acoustic signal travels from the enclosed skin area to the measurement microphone.

In another embodiment, the material may include a hard material.

In an embodiment, the apparatus may also include a retention unit adapted to, during the measurement, hold the apparatus in position over the skin and to provide vibration damping at the proximal periphery. Such retention unit may include i) a stretchable fabric band adapted to run around the head in a stretched state, or ii) a stretchable plastic/elastomeric band adapted to run behind or front or over the head in a stretched state, or iii) an adhesive tape running over the distal end and adapted to affix to skin area outside the proximal periphery on either side of the proximal periphery, or iv) an adhesive at the material adapted to affix to the skin. The retention unit such the bands apply necessary pressure on the apparatus such that the material is pressed against the skin for obtaining vibration damping at the proximal periphery.

In an embodiment, the material includes an adhesive adapted to be removably attached to skin of the user during measurement. In another embodiment, the material is adapted to be attached to a first face of a double-sided adhesive tape. A second face of the adhesive tape is adapted to be removably attached to the specific skin area during measurement. These arrangements or the previously discussed retention units allow for creating a sealed attachment between the specific skin area and the proximal periphery, thus the acoustic signal is effectively transmitted from the skin surface enclosed within the proximal periphery to the measurement microphone.

In different embodiments, the skin area enclosed within the proximal periphery is selected from one or more of skin area at mid-section of a forehead of the bone conduction hearing aid user, or skin area that is substantially close to the mid-section of the forehead, or skin area over mastoid region of the skull on same side or opposite to the position of the bone conduction hearing aid. In other words, the material of the proximal periphery contacts specific skin area at the mid-section of the forehead and/or substantially close to the mid section and/or at the mastoid region. The skilled person will appreciate that other suitable skin area may also be utilized skin area may be chosen to be in close proximity to the bone conduction hearing aid. However, with change in the distance of the skin area from the vibrator of the bone conduction hearing aid, such choice of chosen skin area would affect the vibrations produced at the skin especially for high frequency sound signals.

In different implementations, the mastoid region may include the mastoid region associated with the ear side having the bone conduction hearing aid or mastoid region opposite to the ear side having the bone conduction hearing aid. The earlier implementation allows for evaluating the transfer function for bone conduction hearing aid on same side of the measurement site and the latter implementation allows for evaluating transfer function in view of transcranial attenuation.

The measurement microphone may be selected from a group consisting of condenser microphones, piezoelectric microphones commonly referred to as Acoustic Pressure Sensors. Other microphone designs may also be used such as magnetic microphones, fiber optic microphones, and Micro Electro-Mechanical Systems (MEMS). The diameter of the microphone, defining the distal surface area, may be chosen by considering that larger diameter microphones have higher sensitivity and are better for low frequency and low noise measurements, while smaller diameter microphones are better suited from high frequency and high amplitude measurements.

The measurement microphone is adapted to receive the acoustic signal and to convert the received acoustic signal into a received electrical signal. Typically, the measurement microphone generates a time-varying voltage representing the electrical signal in response to the received acoustic signal.

The waveform of the received electrical signal coming out of the measurement microphone is identical or substantially identical to the waveform of the acoustic signal received at the measurement microphone. The measurement microphone generally acts in a linear fashion, so every time the pressure of the input acoustic signal doubles, for instance, the output voltage also doubles. For a sound pressure of specific frequency, this relationship between the output voltage and the size of the input sound pressure is known as pressure sensitivity of the measurement microphone.

The received electrical signal is then received at a determination unit, which is adapted to determine the characteristics of the received electrical signal.

In one embodiment, the determined characteristics is the voltage output of the received electrical signal. As indicated earlier, the time-varying voltage output from the measurement microphone will generally be in proportion to characteristics of the acoustic signal received at the measurement microphone. For example if acoustic signal received at the measurement microphone has a frequency of 500 Hz, the output of the measurement microphone will be a time-varying voltage that has a frequency of approximately 500 Hz. If the amplitude of the acoustic signal received at the measurement element is increased, the time-varying voltage output of the measurement microphone will increase in a generally linear fashion. Thus, determining the voltage output using the determination unit enables characterization of the acoustic signal, thus in turn determining the characteristics of the vibrations produced at the skull by bone conduction hearing aid in response to the applied sound signal.

In another embodiment, the determined characteristics is the sound pressure level (dB SPL) or sound pressure (Pa) of the acoustic signal. The determination unit may be adapted to determine sound pressure level or sound pressure of the received acoustic signal by utilizing the frequency specific pressure sensitivity of the measurement microphone and the determined voltage output of the received electrical signal. The apparatus may include a memory or may access a locally available or remote database that are adapted to store the pressure sensitivity data of the measurement microphone; the determination unit may be adapted to access the stored pressure sensitivity data. Thus, determining the sound pressure level or sound pressure of the acoustic signal using the determination unit enables characterization of the acoustic signal, thus in turn determining the characteristics of the vibrations produced at the skull by bone conduction hearing aid in response to the applied sound signal.

In yet another embodiment, the determined characteristics is the force applied by the acoustic signal at the diaphragm of the measurement microphone. The determination unit may be adapted to determine the applied force at the diaphragm of the microphone by utilizing the determined sound pressure level (dB SPL) or sound pressure (Pa) of the acoustic signal (as indicated in the preceding paragraph) and specifications of the measurement microphone such as surface area of the diaphragm of the measurement microphone. The apparatus may include the memory or may access a locally available or remote database that are adapted to store the specification of the measurement microphone; the determination unit may be adapted to access the stored specification. Thus, determining the force applied at the measurement microphone using the determination unit enables characterization of the acoustic signal, thus in turn determining the characteristics of the vibrations produced at the skull by bone conduction hearing aid in response to the applied sound signal.

In these embodiments, where the determined characteristics is the voltage output of the received electrical signal, and/or the sound pressure level (dB SPL) or sound pressure (Pa) of the acoustic signal and/or the force applied by the acoustic signal at the diaphragm of the measurement microphone; the apparatus such as the determination unit may be adapted to compensate for the attenuation, offered by thickness of the skin, in the transfer of vibration from the skull to the skin area. The apparatus may include a memory or may access a locally available or remote database that are adapted to store a correlation data between skin thickness and frequency specific attenuation. The correlation data may be based on a number of measurements made on a large patient sample. The determination unit may be adapted to access the stored correlation data and apply the accessed correlation data in order to optimize the determined characteristic to account for skin thickness based attenuation. The disclosure uses the term determined characteristics but it would be apparent to the skilled person that the disclosure is applicable for the optimized determined characteristics as well. Thus, in different embodiments, the determined characteristics is selected from the group consisting of one or more of the determined characteristics and optimized determined characteristics.

In an embodiment, the determination unit is adapted to determine, based on the determined characteristics of the received electrical signal, a quantity representative of vibrational force produced at a skull by the bone conduction device in response to the sound signal. Additionally or alternatively, the determination unit is adapted to generate a calibration data i) by comparing the quantity with a comparable quantity associated with the predefined characteristics of the sound signal and/or ii) by comparing the quantity with a comparable quantity comprising a calibration curve between a related quantity and a related vibrational force produced at the skull.

In an embodiment, the quantity includes the voltage output of the received electrical signal and the comparable quantity includes a voltage corresponding to the current applied to the coil of the transducer for producing the desired frequency specific signal force that represents the sound signal of the predefined characteristics. In another embodiment, the quantity includes the sound pressure level (dB SPL) or sound pressure (Pa) of the acoustic signal and the comparable quantity includes sound pressure level (dB SPL) of the sound signal or sound pressure level (dB SPL) corresponding to the current applied to the coil of the transducer for producing the desired frequency specific signal force. In yet another embodiment, the quantity includes the force applied by the acoustic signal at the diaphragm of the measurement microphone and the comparable quantity includes the desired frequency specific vibrational force. The desired frequency specific vibrational force is a function of hearing loss of the user, typically expressed in user's audiogram, of the bone conduction hearing aid. In yet another embodiment, the quantity includes the voltage output of the received electrical signal and the comparable quantity includes a calibration curve between a related quantity and a related vibrational force produced at the skull. The related quantity includes voltage produced corresponding to related vibrational force produced at the skull across a patient population. The calibration curve is typically frequency specific or frequency band specific. The skilled person would appreciate that instead of voltage output, other calibration curves such as between the sound pressure level (dB SPL) or sound pressure (Pa) of the acoustic signal and the related vibrational force and/or the force applied by the acoustic signal at the diaphragm of the measurement microphone and the related vibrational force may also be used.

In an embodiment, the determination unit is adapted to determine the difference between the compared quantity and the comparable quantity. Thus, the determination unit is adapted to generate the calibration data in dependence on the comparison result. For example, if the comparison between the determined vibrational force produced at the skull in response to the sound signal of a specific level and frequency reveals a value less than the desired vibrational force, then voltage applied across (current passing through) the coil of the vibration unit to produce the signal force is increased, until the determined vibrational force reaches the desired vibrational force. The increase in the voltage applied across (current passing through) the coil represents the calibration data. Similarly calibration data may also be generated based on a comparison of the determination sound pressure or sound pressure level with the level of the sound signal of a specific frequency and/or comparison of the determined voltage output with the voltage applied across (current passing through) the coil corresponding to the sound signal of specific level and frequency. As an another illustrative example, the voltage output of the received electrical signal is compared with the calibration curve and a calibration force corresponding to the voltage output representation at the calibration curve is compared with frequency specific desired force. The determination unit is adapted to utilize the difference in the calibration force and the desired force to generate calibration data, which may include either increasing or decreasing the voltage applied across (current passing through) the coil of the transducer. Such increase or decrease represents the calibration data. Other calibration curves may also be used to generate the calibration data.

In an embodiment, the apparatus further includes an adjustment module that is adapted to receive the calibration data, and adjust a setting of the bone conduction device in accordance with the received calibration data. In one implementation, the adjustment module includes a fitting module. In an implementation, the adjustment module includes a client application running on a smartphone. In an embodiment, the adjustment module includes a controller integrated within the bone conduction hearing aid. The fitting module and/or client application and/or controller is adapted to receive the calibration data from the determination unit and in accordance to the received calibration data, adjusts the bone conduction hearing aid such that frequency specific desired force in accordance with user's audiogram is produced at the skull.

In an embodiment, the apparatus includes a diaphragm adapted to form a surface across the proximal periphery. During the measurement, the diaphragm is adapted to contact the specific skin area of the user of the bone conduction device and to vibrate in accordance with the vibrations produced at the skin area in contact with the diaphragm. The vibrations represent the vibrations produced within the user by the bone conduction device in response to the sound. During the measurement, the measurement microphone is adapted to receive an acoustic signal in dependence on the vibration of the diaphragm along the signal transmission cavity.

In an embodiment, the determination unit is adapted to further determine whether the comparison between the determined quantity and the comparable quantity within acceptable range. If so, then the bone conduction hearing aid is not calibrated. This may also include not generating the calibration data. In another embodiment, the determination unit is adapted to further determine, if the generated calibration data is within an acceptable limit. If so, then the bone conduction hearing aid is not calibrated. In either embodiments, the acceptable range and the acceptable limit is typically frequency dependent and is usually dependent on whether not calibrating the bone conduction hearing aid deteriorates user's hearing perception. The acceptable range and the acceptable limit may be stored in the memory and is generally pre-defined. Using either of such embodiments allow for reducing power consumption while ensuring that user's hearing perception is not deteriorated or substantially deteriorated. This may also allow for giving user time enough to adjust to a specific hearing aid setting.

In an embodiment, the apparatus is integrated with the bone conduction device such that the apparatus provides the calibration data to the bone conduction device to dynamically adjust settings of the bone conduction device for obtaining a predetermined transfer function. The predetermined transfer function relates to the desired force in accordance with frequency specific hearing threshold of the user. The dynamic adjustment of setting refers to the speech processor adapted to i) analyze the electrical signal, corresponding to the incoming sound, ii) receive from the determination unit frequency specific calibration data, and iii) adjusting the frequency specific current in coil in accordance with the calibration data. In an embodiment, the determination unit is adapted to generate calibration data in accordance with the disclosure made previously in the disclosure. In another embodiment, the bone conduction device and/or the apparatus includes a memory that is adapted to store the calibration data corresponding to a stored predefined characteristics. In response to the an incoming audio signal (incoming sound), the apparatus integrated with the bone conduction device compares the stored predefined characteristics with characteristics of the incoming audio signal; and the apparatus is adapted to access the memory and provide related calibration data, in accordance with result of the comparison, to the adjustment module integrated with the bone conduction device to dynamically adjust the setting of the bone conduction device.

In an embodiment, the apparatus is integrated with the bone conduction device such that the apparatus provides the calibration data to the bone conduction device to dynamically adjust settings of the bone conduction device for obtaining a predetermined transfer function. The predetermined transfer function relates to the desired force in accordance with frequency specific hearing threshold of the user. The dynamic adjustment of setting refers to the speech processor adapted to i) analyze the electrical signal, corresponding to a test signal stored within the hearing aid, ii) receive from the determination unit frequency specific calibration data, and iii) adjusting the frequency specific adjustment in accordance with the calibration data. The test signal may include the input electrical signal of predetermined characteristics such as frequency. In an embodiment, the determination unit is adapted to generate calibration data in accordance with the disclosure made previously in the disclosure.

In an embodiment, the apparatus includes the memory that is adapted to store at least one or more of characteristics of the transmission cavity, the characteristics defining the frequency specific amplification of the acoustic signal produced within the cavity. The dimensions of the cavity is chosen such that the cavity allows passage of the frequency of the acoustic signal. The determination unit is adapted to access the frequency specific amplification and accordingly adjust the quantity that is to be compared with the comparable quantity. Alternatively, the adjustment module may be adapted to access the stored frequency specific amplification and compensate for the amplification produced in the acoustic signal by the acoustic signal transmission cavity.

In an embodiment, a proximal surface area, as defined by area enclosed within the proximal periphery, is larger or substantially larger than a distal surface area at the distal end. In different embodiments, the ratio between the proximal surface area and the distal surface area is approximately at least 8 such as at least 10, such as at least 12, such as at least 14 and so on. For example, the proximal surface area as defined by a circular proximal periphery having a diameter of approximately 7 mm and the distal surface area is approximately 2 mm. In another example, the proximal surface area as defined by a circular proximal periphery having a diameter of approximately 12 mm and the distal surface area is approximately 1.5 mm. In some implementation, the distal surface area may be defined by diaphragm of the microphone alone. In different embodiments, the change is surface area from proximal end to the distal end is selected from a gradual change, stepped change, and a combination thereof. The stepped change relates to an intermediary surface area of an intermediary section between the proximal end and the distal end is lesser than the proximal surface area but higher than the distal surface area. The "combination thereof" is defined by a gradual change in the surface area where the change is incorporated by a series of consecutive stepped changes from proximal end to the distal end. The series of consecutive steps may be continuous or discontinuous along the length of the apparatus, i.e. from proximal end to the distal end.

In an embodiment, the distance between the proximal end and distal end is in the range of 5 mm to 10 mm in order to allow for effective transmission of vibrations such as between 6 mm and 9 mm. However, other distances may also be implemented and within the scope of the disclosure.

In an embodiment, a distance between the proximal periphery and the distal end is selected from a group consisting of a fixed distance and adjustable distance.

Additionally or alternatively, the proximal surface area and the distal surface area is selected from a group consisting of relatively fixed surface area or relatively adjustable surface areas. The proximal surface area is the area surrounded by the proximal periphery and the distal surface area is the area surrounded by the distal end.

In an embodiment, the acoustic signal transmission cavity comprises a circular shaped periphery at the proximal end and a circular shaped microphone inlet at the distal end. The dimensions of the cavity is configured in order to allow effective transmission of the detected vibrations. For example, the ratio between a diameter of the circular shaped microphone inlet and a diameter of the circular shaped periphery is preferably lower than 1/7. In a separate or combinable embodiment, ratio of a distance between the circular shaped periphery at the proximal end and the circular shaped microphone inlet and the diameter of the circular shaped periphery is preferably equal or lower than 1/1.

In one embodiment, the apparatus includes a proximal unit comprising the proximal end and a distal unit comprising the distal end. The proximal unit and the distal unit may be adapted to move with respect to each other along a longitudinal axis. Additionally or alternatively the proximal unit is adapted to adjust proximal parameters defining the surface area of the proximal end and/or the distal unit is adapted to adjust distal parameters defining the surface area of the distal end.

According to another embodiment, a method for measuring a transfer function of a bone conduction device using an apparatus is disclosed. The method includes i) during a measurement, positioning a proximal periphery comprising a material of the apparatus such that the material contacts a specific skin area of a user of the bone conduction device, ii) receiving at the bone conduction device a sound signal of a predefined characteristics and producing vibrations within the user in response to the received sound signal, iii) transmitting an acoustic signal from a skin area enclosed within the proximal periphery along an acoustic signal transmission cavity defined by a side surface of the apparatus in combination with the proximal periphery and a distal end of the apparatus to the distal end, the vibrations produced at the enclosed skin area being representative of the vibrations produced within the user by the bone conduction device; and iv) receiving, during the measurement, the acoustic signal at a measurement microphone positioned at the distal end.

In an embodiment, the method may further include i) converting, using the measurement microphone, the received acoustic signal from into an electrical signal; ii) receiving the electrical signal at a determination unit and determining, using the determination unit, characteristics of the electrical signal; iii) determining, based on the determined characteristics of the electrical signal, a quantity representative of vibrational force produced at a skull by the bone conduction device in response to the sound signal; iv) generating a calibration data by comparing the quantity with a comparable quantity associated with the predefined characteristics of the sound signal; and v) calibrating the bone conduction device in accordance with the generated calibration data.

In an embodiment, where more than one apparatus is positioned at different positions over user's skull, acoustic signals from different skin areas is gathered. This allows for evaluating transmission of the sound signal along the skull of the user. This may thus be helpful in accounting for user specific transmission losses such as transcranial attenuation while calibrating the bone conduction hearing aid. Therefore, the method may include, positioning more than one apparatus at different skin area locations, delivering the sound signal of a predefined characteristics to the bone conduction hearing aid, receiving acoustic signals at measurement microphones of each apparatus, generating respective electrical signals corresponding to the received acoustic signals using corresponding measurement microphone, determining the characteristic of each electrical signal, determining a cumulative characteristic by calculating a weighted average of the characteristics of each electrical signal, generating a calibration data based on the weighted average and adjusting the bone conduction device in accordance with the weighted average.

In another embodiment, the apparatus is configured for sensing vibrations produced by the bone conduction hearing aid in a sound field comprising one of a free sound field or diffuse sound field or quasi-free sound field.

Generally, in the free sound field, the walls, ceiling and floor of a room exert a negligible effect on the sound waves produced by a sound source like a loudspeaker in the room where the vibration sensing using the claimed apparatus is performed. Typically, this condition is met in an anechoic room. Generally, in the diffuse sound field, the walls, ceiling and floor of a room exert substantial effect on the sound waves produced by a sound source like a loudspeaker in the room where the vibration sensing using the claimed apparatus is performed. Generally, in a quasi-free sound field, the walls, ceiling and floor of a room exert only a moderate effect on the sound waves produced by a sound source like a loudspeaker in the room where the vibration sensing using the claimed apparatus is performed. The sound field is typically influenced by room reverberation and by the inverse square law with respect to distance between the sound source and the user of the bone conduction hearing aid.

In above-mentioned sound fields, the bone conduction hearing aid is configured to produce vibration at the skull of the user in response to the sound received from a sound source present in the sound field. However, there exists a likelihood that the transmission of the acoustic signal, based on the skull vibrations, from the skin area enclosed within the proximal periphery to the measurement microphone gets mixed with sound from the sound field leaking through the material, adapted to contact the skin and to enclose a skin area within the proximal periphery, into the signal transmission cavity. This would result in a mixed acoustic signal, reaching the measurement microphone, that incorrectly represent the vibrations produced by the bone conduction hearing aid.

In different embodiments, the disclosure proposes two possible ways of countering the problem of mixed signals.

In a first embodiment, the measurement microphone is configured to receive a leakage acoustic signal entering through the material into the signal transmission cavity when the apparatus is positioned over the skin area enclosed within the proximal periphery and the bone conduction device is switched off. In other words, the measurement microphone only receives the leakage acoustic signal. The leakage acoustic signal corresponds to frequency specific sound of a specific characteristics produced by the sound source such as a loudspeaker in the sound field. The measurement microphone is further configured to convert the leakage acoustic signal into leakage electrical signal. The determination unit is configured to determine characteristics of the leakage electrical signal. The determined characteristics of the leakage electrical signal corresponding to the sound of the specific characteristics are stored in a storage unit. The storage unit may be comprised in the apparatus or represents the memory of the bone conduction hearing aid.

In the sound field situations utilizing a sound of a particular frequency and with the bone conduction hearing aid in operation, the bone conduction hearing aid produces skull vibration in accordance with the sound received from the sound source in the sound field. The measurement microphone is configured to receive a mixed acoustic signal comprising the leakage acoustic signal, corresponding to the sound entering through the material into the signal transmission cavity, mixed with the acoustic signal in dependence of the vibrations produced at the skin area enclosed within the proximal periphery. The measurement microphone is adapted to convert the mixed acoustic signal into a mixed electrical signal, which is received at the determination unit adapted to determine the mixed characteristics of the received mixed electrical signal. The determination unit is further configured to access the determined characteristics, corresponding to the particular frequency, of the leakage electrical signal from the storage unit and apply a correction based on the accessed determined characteristics to the mixed characteristics in order to cancel the effect of the leakage acoustic signal in the mixed characteristic for obtaining characteristic of only the acoustic signal that depends on the vibrations produced at the skin area enclosed within the proximal periphery.

In a second embodiment, the apparatus further comprises an external measurement microphone positioned exterior to the signal transmission cavity. The external measurement microphone may preferably be embedded in the material, i.e. in the leakage acoustic pathway. In the sound field situations utilizing a sound from a sound source within the sound field and with the bone conduction hearing aid in operation, the bone conduction hearing aid produces skull vibration in accordance with the sound received from the sound source. The measurement microphone is configured to receive a mixed acoustic signal comprising the leakage acoustic signal, corresponding to the sound entering through the material into the signal transmission cavity, mixed with the acoustic signal in dependence of the vibrations produced at the skin area enclosed within the proximal periphery. The measurement microphone is adapted to convert the mixed acoustic signal into a mixed electrical signal, which is received at the determination unit adapted to determine the mixed characteristics of the received mixed electrical signal. The external measurement microphone is configured to receive a sound from the sound source positioned in the sound field and to convert the sound into an external electrical signal. The external electrical signal is typically representative of the leakage acoustic signal. The determination unit is configured to receive the external electrical signal and is configured to determine the characteristic of the external electrical signal. The determination unit is further configured to apply correction based on the determined characteristic of the external electrical signal to the mixed characteristics in order to cancel the effect of the leakage acoustic signal in the mixed characteristic for obtaining characteristic of only the acoustic signal that depends on the vibrations produced at the skin area enclosed within the proximal periphery.

According to an embodiment, a bone conduction hearing aid comprising the apparatus described in the disclosure is also included. In different embodiments, the bone conduction hearing aid may include one or more features of the apparatus.

BRIEF DESCRIPTION OF ACCOMPANYING FIGURES

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other embodiments. These and other embodiments, features and/or technical effect will be apparent from and elucidated with reference to the illustrations described hereinafter in which:

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, steps, processes, etc. (collectively referred to as "elements").

Figure 1A:
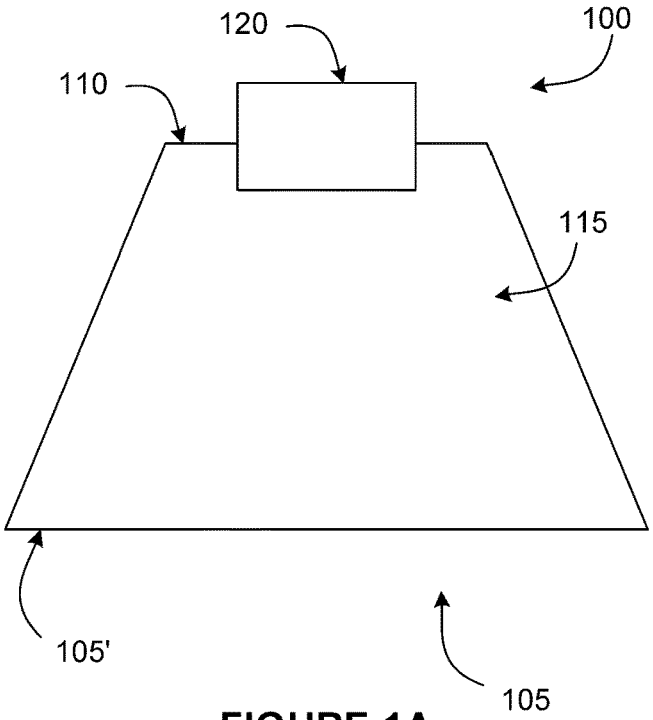
FIG. 1A illustrates an apparatus for sensing vibrations produced by a bone conduction hearing aid according to an embodiment of the disclosure.
Figure 1B:
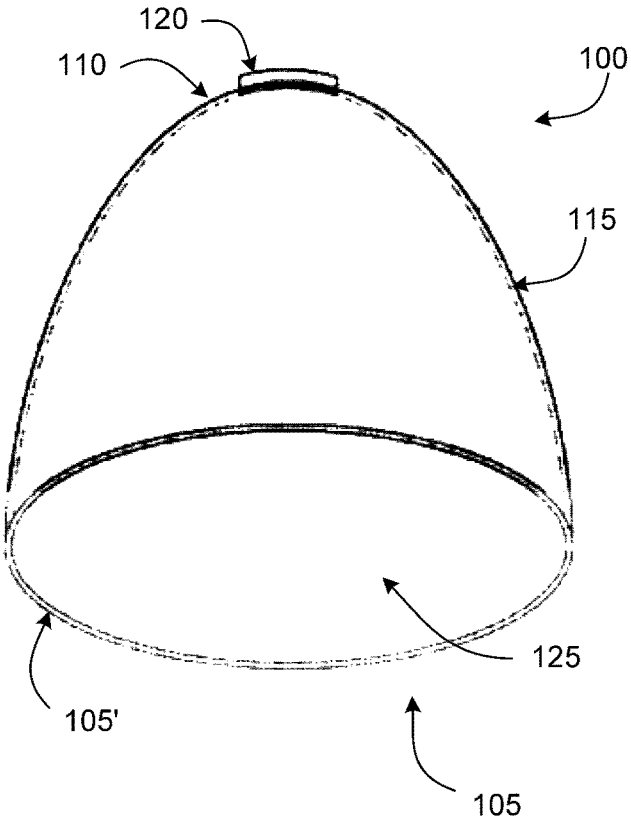
FIG. 1B illustrates an apparatus for sensing vibrations produced by a bone conduction hearing aid according to an embodiment of the disclosure.

FIG. 1A and FIG. 1B illustrate an apparatus for sensing vibrations produced by a bone conduction hearing aid according to an embodiment of the disclosure. The apparatus 100 is schematically represented, where the apparatus includes a proximal end 105. The proximal end includes a proximal periphery 105', which includes a material that is adapted to contact a skin of a user of the bone conduction device during a measurement. The proximal periphery is adapted to enclose a skin area (225, see FIG. 2). The apparatus further includes a distal end 110 comprising a measurement microphone 120. The measurement microphone 120 is adapted to, during the measurement, receive an acoustic signal (220, see FIG. 2) in dependence of vibrations produced at the skin area, the vibrations being representative of skull vibrations (215, see FIG. 2) produced within the user by the bone conduction hearing aid in response to a sound signal. The apparatus further includes a side surface 115. The side surface in combination with the proximal periphery 105' and the distal end 110 defines an acoustic signal transmission cavity 125 that allows transmission of the acoustic signal (220, FIG. 2) from the skin area (225, see FIG. 2) to the measurement microphone 120 during the measurement.

Figure 2:
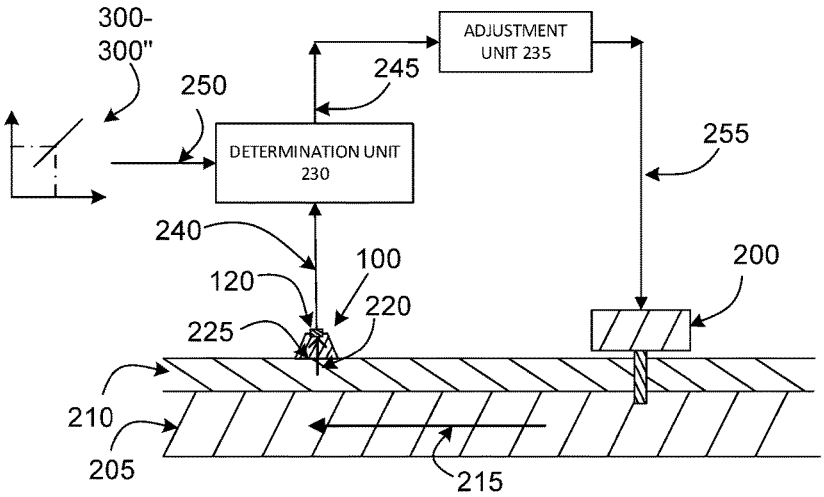
FIG. 2 illustrates an apparatus for sensing vibrations produced by a bone conduction hearing aid during measurement according to an embodiment of the disclosure.

FIG. 2 illustrates an apparatus 100 for sensing vibrations 215 produced by a bone conduction hearing aid 200 during measurement according to an embodiment of the disclosure. A sound signal of predefined characteristics is applied to the bone conduction hearing aid 200. The transducer (vibration unit) of the bone conduction hearing aid produces skull vibrations 215 at the skull 205 within the user in response to the sound signal. 210 represents the tissue, defining skin thickness, between the skull and the skin. The skull vibrations 215 results in vibration of the skin overlying the skull where vibrations are produced. During the measurement, the proximal periphery is adapted to enclose a skin area 225 where the skin vibrations are produced. The skin vibrations from the skin area enclosed within the proximal periphery are transmitted as an acoustic signal 220 along the transmission cavity (125, see FIG. 1B). The measurement microphone 120 is adapted to convert the received acoustic signal 220 into an electrical signal 240. A determination unit 230 is adapted to receive the electrical signal 240 and determine characteristics of the electrical signal 240. The determination unit 230 may further be adapted to determine, based on the determined characteristics of the electrical signal 240, a quantity representative of vibrational force produced at the skull 205 by the bone conduction device 200 in response to the sound signal. The determination unit may also be adapted to generate a calibration data 245 by comparing the quantity with a comparable quantity 250 associated with the predefined characteristics of the sound signal and/or with a comparable quantity 250 comprising a calibration curve 300-300" (described later) between a related quantity and a related vibrational force produced at the skull. The quantity, related quantity, related vibrational force and comparable quantity are described earlier in the text. An adjustment unit 235 is adapted to receive the calibration data 245 and adjust a setting of the bone conduction device by sending an adjustment signal 255 in accordance with the received calibration data.

Figure 3A:
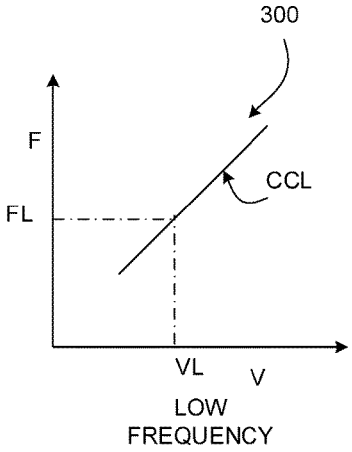
FIG. 3A illustrates a calibration curve for a low frequency range according an embodiment of the disclosure.
Figure 3B:
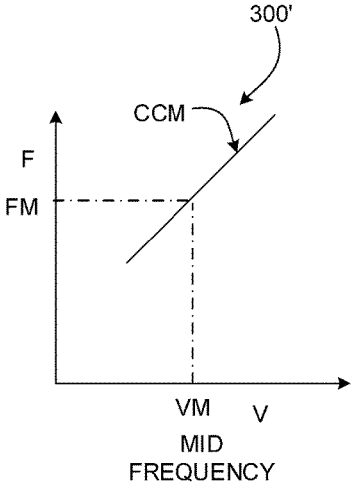
FIG. 3B illustrates a calibration curve for a mid-frequency range according to an embodiment of the disclosure.
Figure 3C:
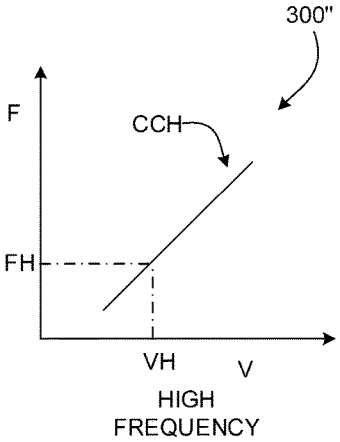
FIG. 3C illustrates a calibration curve for a high frequency range according to an embodiment of the disclosure.

FIG. 3A illustrates a calibration curve 300 for a low frequency range according an embodiment of the disclosure. FIG. 3B illustrates a calibration curve 300' for a mid-frequency range according to an embodiment of the disclosure. FIG. 3C illustrates a calibration curve 300" for a high frequency range according to an embodiment of the disclosure. In an embodiment, the low frequency range is between 100 Hz to 600 Hz, the mid frequency range is between 600 Hz to 2000 Hz, and high frequency range is between 2000 Hz to 10,000 Hz. In other embodiments, different ranges may be defined and is within the scope of this disclosure.

The calibration curve shows a relationship between a related quantity and a related vibrational force produced at the skull. In the illustrated embodiment, the related quantity includes voltage produced corresponding to related vibrational force produced at the skull across a patient population. The calibration curve is typically frequency specific or frequency band specific as shown. Using the calibration curve, the determined voltage from the electrical signal (240, see FIG. 2) may be used to determine the vibrational force at the skull. The determined vibrational force can then be compared with the frequency specific desired force to generate the calibration data.

For mid-frequency range (FIG. 3B), the voltage corresponding to the electrical signal (240, see FIG. 2) increase linearly with an increase in the force generated at the skull (205, see FIG. 2) as represented by curve CCM. Thus, if the voltage corresponding to the electrical signal is VM, then the determined vibrational force at the skull is FM. FM is then compared to the desired force and a calibration data may be generated. Typically, for same voltage measurements, the vibrational force produced at the skull (205, see FIG. 2) for the mid frequency range is higher than that for the low frequency range and that for the high frequency range.

For high frequency range (FIG. 3C), the voltage corresponding to the electrical signal (240, see FIG. 2) increases linearly with an increase in the force generated at the skull (205, see FIG. 2) as represented by the curve CCH. Thus, if the voltage corresponding to the electrical signal is VH, then the determined vibrational force at the skull is FH. FH is then compared to the desired force and a calibration data may be generated. Typically, the slope of the curve CCL, curve CCM and curve CCH are same; however for same voltage measurements, the vibrational force produced at the skull (205, see FIG. 2) is a) higher for the mid frequency range compared to that of the high frequency range, and b) higher for the low frequency range compared to that of the high frequency range.

For low frequency range (FIG. 3A), the voltage corresponding to the electrical signal (240, see FIG. 2) increases linearly with an increase in the force generated at the skull (205, see FIG. 2) as represented by the curve CCL. Thus, if the voltage corresponding to the electrical signal is VL, then the determined vibrational force at the skull is FL. FL is then compared to the desired force and a calibration data may be generated. Typically, the slope of the curve CCL, curve CCM, and curve CCH are same; however for same voltage measurements, the vibrational force produced at the skull (205, see FIG. 2) is a) higher for the mid frequency range compared to that of the low frequency range, and b) lower for the high frequency range compared to that of the low frequency range.

The skilled person would appreciate that instead of voltage output, other calibration curves such as between the sound pressure level (dB SPL) or sound pressure (Pa) of the acoustic signal and the related vibrational force and/or the force applied by the acoustic signal at the diaphragm of the measurement microphone and the related vibrational force may also be used. The voltage output of the received electrical signal is compared with the calibration curve and a calibration force corresponding to the voltage output representation at the calibration curve is compared with frequency specific desired force. The determination unit is adapted to utilize the difference in the calibration force and the desired force to generate calibration data, which may include either increasing or decreasing the voltage applied across (current passing through) the coil of the transducer. Such increase or decrease represents the calibration data. Other calibration curves may also be used to generate the calibration data.

Figure 4:
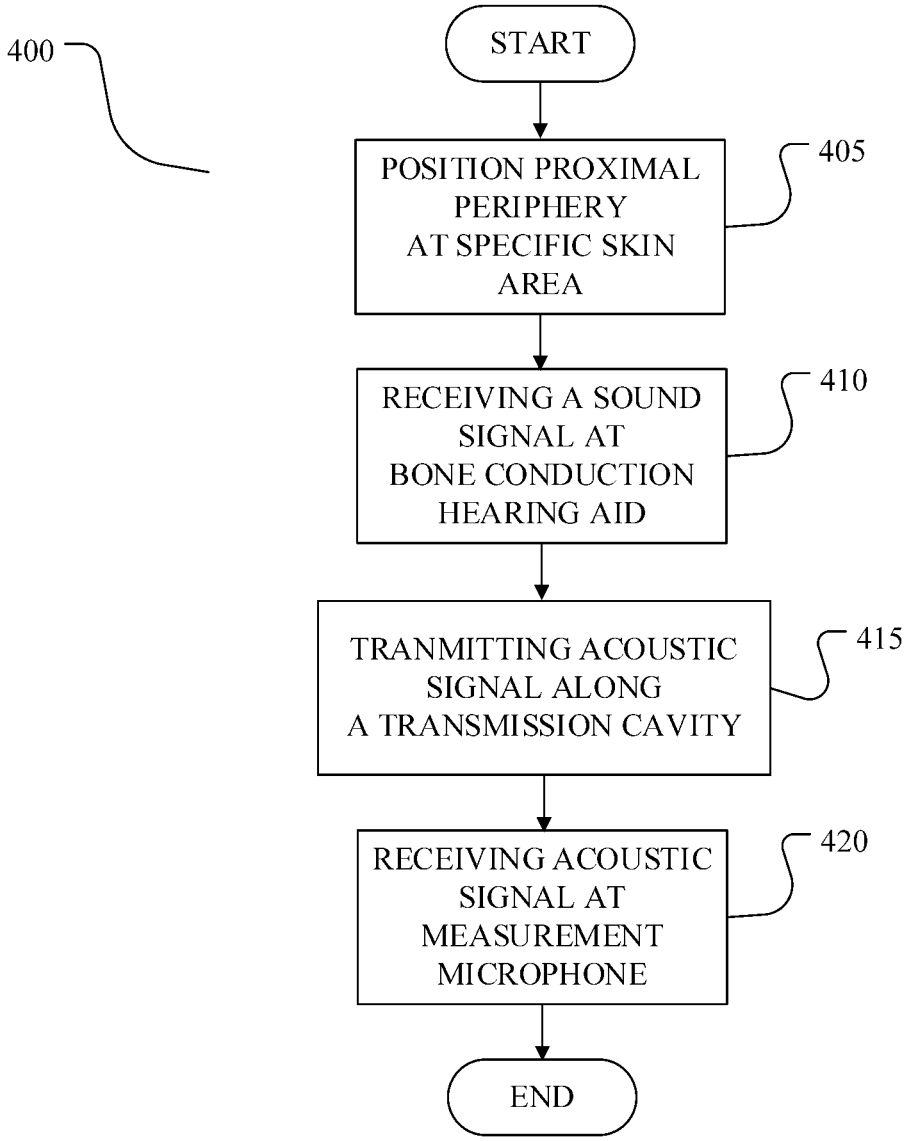
FIG. 4 illustrates a method for sensing for sensing vibrations produced by a bone conduction hearing aid according to an embodiment of the disclosure.

FIG. 4 illustrates a method for sensing for sensing vibrations produced by a bone conduction hearing aid according to an embodiment of the disclosure. The method 400 includes, during a measurement, at 405 positioning a proximal periphery comprising a material of the apparatus such that the material contacts a specific skin area of a user of the bone conduction device. At 410, receiving at the bone conduction device a sound signal of a predefined characteristics and producing vibrations within the user in response to the received sound signal. At 415, transmitting an acoustic signal from a skin area enclosed within the proximal periphery along an acoustic signal transmission cavity defined by a side surface of the apparatus in combination with the proximal periphery and a distal end of the apparatus to the distal end, the vibrations produced at the enclosed skin area being representative of the vibrations produced within the user by the bone conduction device. Lastly, at 420, receiving, during the measurement, the acoustic signal at a measurement microphone positioned at the distal end.

Figure 5:
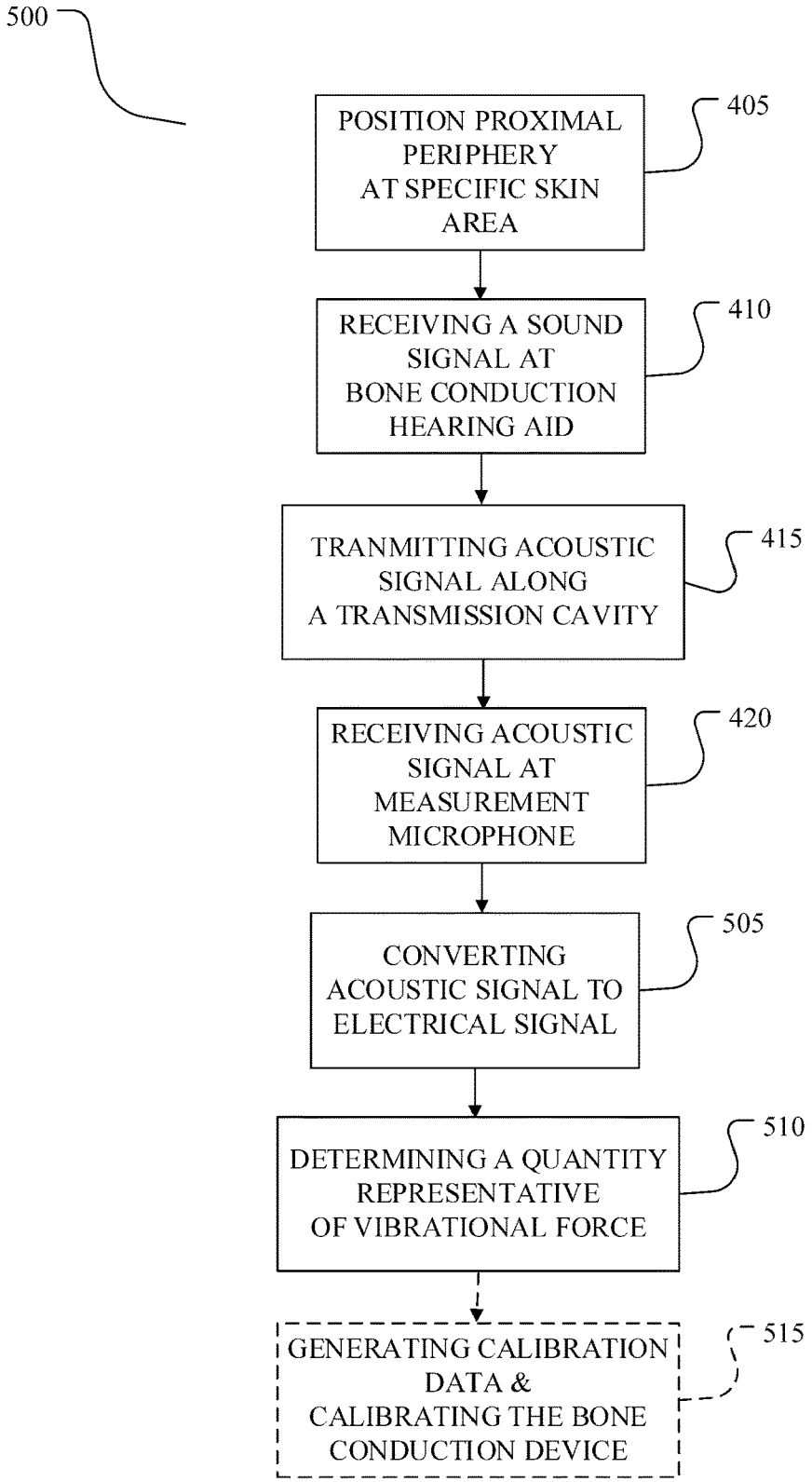
FIG. 5 illustrates a method for sensing vibrations produced by a bone conduction hearing aid according to an embodiment of the disclosure.

FIG. 5 illustrates a method 500 for sensing vibrations produced by a bone conduction hearing aid according to an embodiment of the disclosure. This embodiment includes the steps recited in the previous embodiment and additional steps. The additional steps include at 505 using the measurement microphone, the received acoustic signal is converted into an electrical signal, which is received at a determination unit. The determination unit is adapted to determine characteristics of the electrical signal. At 510, based on the determined characteristics of the electrical signal, a quantity representative of vibrational force produced at a skull by the bone conduction device in response to the sound signal is determined.

In an embodiment, the determination unit is adapted to further determine whether the comparison between the determined quantity and the comparable quantity within acceptable range. If so, then the bone conduction hearing aid is not calibrated. This may also include not generating the calibration data. In another embodiment, the determination unit is adapted to further determine, if the generated calibration data is within an acceptable limit. If so, then the bone conduction hearing aid is not calibrated.

In either embodiments, the acceptable range and the acceptable limit is typically frequency dependent and is usually stored in the memory and is generally pre-defined.

As a further additional step, in an embodiment, at 515 a calibration data may be generated by comparing the quantity with a comparable quantity associated with the predefined characteristics of the sound signal and/or by comparing the quantity with a comparable quantity comprising a calibration curve between a related quantity and a related vibrational force produced at the skull; and accordingly, the bone conduction device may be calibrated in accordance with the generated calibration data.

Figure 6:
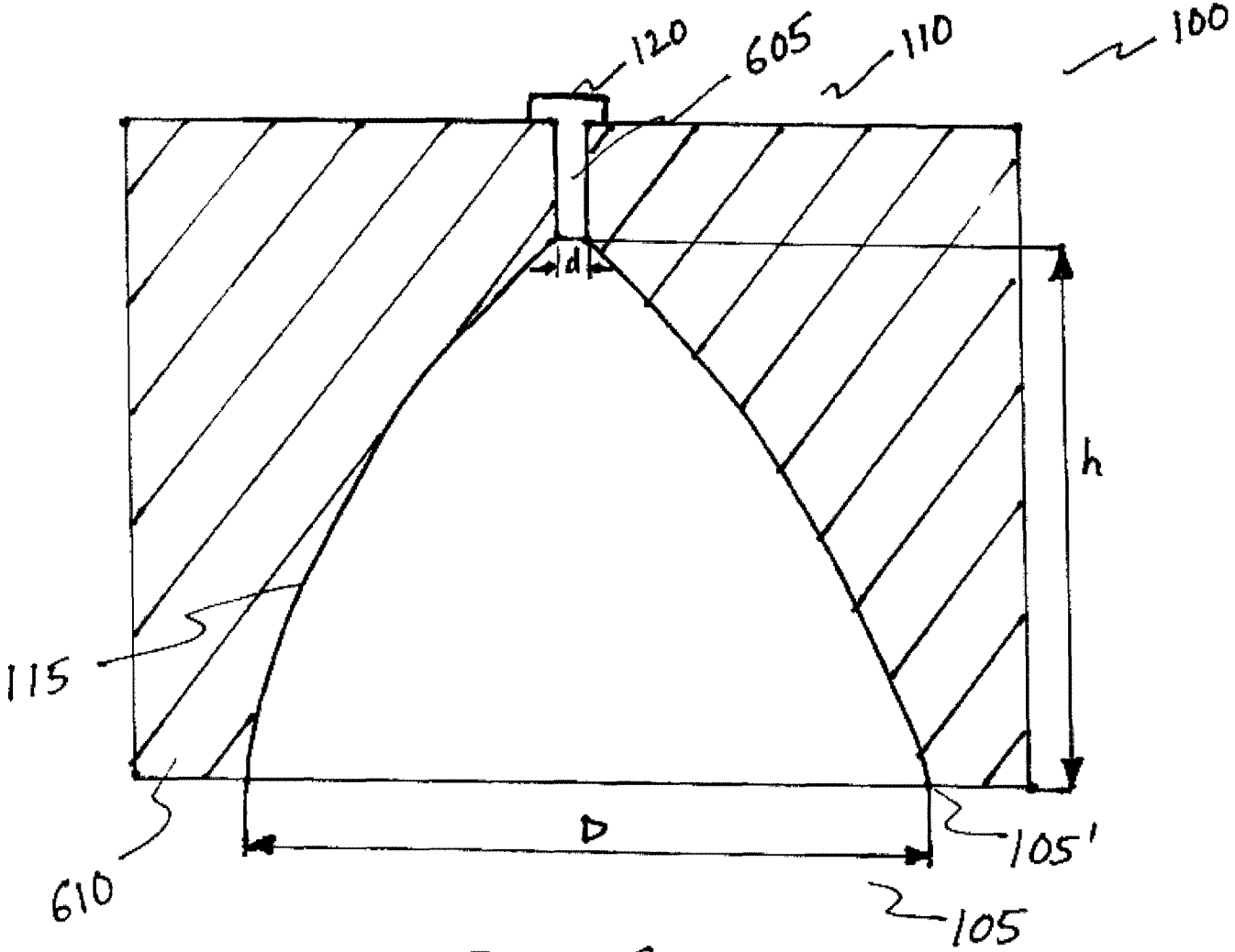
FIG. 6 illustrates an apparatus for sensing vibrations produced by a bone conduction hearing aid according to an embodiment of the disclosure.

FIG. 6 illustrates an apparatus for sensing vibrations produced by a bone conduction hearing aid according to an embodiment of the disclosure. The reference numerals common with FIG. 1 illustrates the same elements. In addition, the figure illustrates microphone inlet 605 at the distal end 110. In an embodiment, the acoustic signal transmission cavity comprises a circular shaped periphery 105' at the proximal end 105 and a circular shaped microphone inlet 605 at the distal end 110. The dimensions of the cavity is configured in order to allow effective transmission of the detected vibrations. For example, the ratio between a diameter d of the circular shaped microphone inlet and a diameter D of the circular shaped periphery is preferably lower than 1/7. In a separate or combinable embodiment, ratio of a distance h between the circular shaped periphery at the proximal end and the circular shaped microphone inlet and the diameter D of the circular shaped periphery is preferably equal or lower than 1/1. 610 represents the material.

In an embodiment, the material may form the side surface as shown in FIG. 6. The side surface, in combination with the proximal periphery and the distal end, is adapted to define the acoustic signal transmission cavity that allows transmission of the acoustic signal from the skin area to the measurement microphone during the measurement.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, steps, operations, elements, and/or components, but do not preclude the presence or addition of one or more other features, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

We claim:

1. An apparatus for sensing vibrations produced by a bone conduction device that transmits vibrations to a skull bone of a user, the apparatus comprising:

a proximal end comprising a proximal periphery comprising a material adapted to, during a measurement, contact but not penetrate a skin of the user of the bone conduction device and to enclose a skin area overlaying the skull bone of the user within the proximal periphery, thereby forming an outer perimeter of an acoustic signal transmission cavity;

a distal end comprising a measurement microphone adapted to, during the measurement, receive an acoustic signal via the acoustic signal transmission cavity in dependence of vibrations produced at the skin area, the vibrations being representative of skull vibrations produced within the user by the bone conduction device in response to a sound signal; and a side surface that, in combination with the proximal periphery and the distal end, is adapted to define the acoustic signal transmission cavity that allows transmission of the acoustic signal from the skin area to the measurement microphone during the measurement, wherein said acoustic signal transmission cavity is physically separate from the bone conduction device and does not physically contact the bone conduction device during the measurement, the measurement microphone is configured to receive a leakage acoustic signal in response to sound from a sound source and convert the leakage acoustic signal into a leakage electrical signal when the bone conduction device is switched off;

the measurement microphone is configured to receive a mixed acoustic signal in response to sound from the sound source and convert the mixed acoustic signal into a mixed electrical signal when the bone conduction device is in operation;

the apparatus further comprises a determination unit configured to receive the leakage electrical signal, determine characteristic of the leakage electrical signal and store the determined characteristic of the leakage electrical signal when the bone conduction device is switched off, receive the mixed electrical signal and to determine mixed characteristics of the mixed acoustic signal;

access the determined characteristic of the leakage electrical signal; and apply a correction based on the determined characteristic of the leakage electrical signal to the mixed characteristics in order to cancel effect of the leakage acoustic signal in the mixed characteristic for obtaining characteristic of the acoustic signal that depends on the vibrations produced at the skin area enclosed within proximal periphery.

2. The apparatus according to claim 1, wherein the material is a vibration damping material.

3. The apparatus according to claim 1, further comprising a retention unit adapted to, during the measurement, hold the apparatus in position over the skin and to provide vibration damping at the proximal periphery.

4. The apparatus according to claim 3, wherein the retention unit is selected from a group consisting of a stretchable fabric band adapted to run around the head in a stretched state, a stretchable plastic/elastomeric band adapted to run behind or front or over the head in a stretched state, an adhesive tape running over the distal end and adapted to affix to skin area outside the proximal periphery on either side of the proximal periphery, and an adhesive at the material adapted to affix to the skin.

5. The apparatus according to claim 1, wherein the measurement microphone is adapted to convert the received acoustic signal into a received electrical signal.

6. The apparatus according to claim 5, wherein the determination unit is adapted to receive the received electrical signal and to determine the characteristics of the received electrical signal.

7. The apparatus according to claim 6, wherein the determination unit is adapted to determine, based on the determined characteristics of the received electrical signal, a quantity representative of vibrational force produced at a skull by the bone conduction device in response to the sound signal.

8. The apparatus according to claim 7, wherein the determination unit is adapted to generate a calibration data by comparing the quantity with a comparable quantity associated with predefined characteristics of the sound signal.

9. The apparatus according to claim 8, further comprising an adjustment module that is adapted to receive the calibration data; and adjust a setting of the bone conduction device in accordance with the received calibration data.

10. The apparatus according to claim 7, wherein the determination unit is adapted to generate a calibration data by comparing the quantity with a comparable quantity comprising a calibration curve between a related quantity and a related vibrational force produced at the skull.

11. The apparatus according to claim 10, further comprising an adjustment module that is adapted to receive the calibration data; and adjust a setting of the bone conduction device in accordance with the received calibration data.

12. The apparatus according to claim 1, wherein a proximal surface area, as defined by area enclosed within the proximal periphery, is larger or substantially larger than a distal surface area at the distal end.

13. The apparatus according to claim 1, further comprising a diaphragm adapted to form a surface across the proximal periphery, wherein during the measurement, the diaphragm is adapted to contact the specific skin area of the user of the bone conduction device and to vibrate in accordance with the vibrations produced at the skin area in contact with the diaphragm, the vibrations being representative of the vibrations produced within the user by the bone conduction device in response to the sound; and during the measurement, the measurement microphone is adapted to receive an acoustic signal in dependence on the vibration of the diaphragm along the signal transmission cavity.

14. The apparatus according to claim 1, wherein the apparatus is integrated with the bone conduction device such that the apparatus provides the calibration data to the bone conduction device to dynamically adjust settings of the bone conduction device for obtaining a predetermined transfer function.

15. The apparatus according to claim 14, wherein the bone conduction device and/or the apparatus comprises a memory that is adapted to store the calibration data corresponding to a stored predefined characteristics;

in response to the an incoming audio signal, the apparatus integrated with the bone conduction device compares the stored predefined characteristics with characteristics of the incoming audio signal; and the apparatus is adapted to access the memory and provide related calibration data, in accordance with result of the comparison, to the adjustment module integrated with the bone conduction device to dynamically adjust the setting of the bone conduction device.

16. A method for measuring a transfer function of a bone conduction device that transmits vibrations to a skull bone of a user, the method using an apparatus and comprising:

during a measurement, positioning a proximal periphery comprising a material of the apparatus such that the material contacts but does not penetrate a skin of the user of the bone conduction device, thereby enclosing a skin area overlaying the skull bone within the proximal periphery and forming an outer perimeter of an acoustic signal transmission cavity;

receiving at the bone conduction device a sound signal of a predefined characteristics and producing vibrations within the skull bone of the user in response to the received sound signal;

transmitting an acoustic signal from the skin area enclosed within the proximal periphery along the acoustic signal transmission cavity, which is defined by a side surface of the apparatus in combination with the proximal periphery and a distal end of the apparatus, to the distal end, the vibrations produced at the enclosed skin area being representative of the vibrations produced within the skull bone of the user by the bone conduction device; and receiving, during the measurement, the acoustic signal at a measurement microphone positioned at the distal end, wherein said acoustic signal transmission cavity is physically separate from the bone conduction device and does not physically contact the bone conduction device during the measurement, the measurement microphone is configured to receive a leakage acoustic signal in response to sound from a sound source and convert the leakage acoustic signal into a leakage electrical signal when the bone conduction device is switched off;

the measurement microphone is configured to receive a mixed acoustic signal in response to sound from the sound source and convert the mixed acoustic signal into a mixed electrical signal when the bone conduction device is in operation;

the method further comprises receiving the leakage electrical signal, determine characteristic of the leakage electrical signal and storing the determined characteristic of the leakage electrical signal when the bone conduction device is switched off;

receiving the mixed electrical signal and determining mixed characteristics of the mixed acoustic signal;

accessing the determined characteristic of the leakage electrical signal; and applying a correction based on the determined characteristic of the leakage electrical signal to the mixed characteristics in order to cancel effect of the leakage acoustic signal in the mixed characteristic for obtaining characteristic of the acoustic signal that depends on the vibrations produced at the skin area enclosed within proximal periphery.

17. The method according to claim 16, further comprising converting, using the measurement microphone, the received acoustic signal into an electrical signal;

receiving the electrical signal at a determination unit and determining, using the determination unit, characteristics of the electrical signal;

determining, based on the determined characteristics of the electrical signal, a quantity representative of vibrational force produced at a skull by the bone conduction device in response to the sound signal;

generating a calibration data by comparing the quantity with a comparable quantity associated with the predefined characteristics of the sound signal and/or by comparing the quantity with a comparable quantity comprising a calibration curve between a related quantity and a related vibrational force produced at the skull; and calibrating the bone conduction device in accordance with the generated calibration data.

18. A system comprising a bone conduction hearing aid and the apparatus of claim 1.

* * * * *